United States Patent [19]

Risko et al.

[11] Patent Number: 4,934,127

[45] Date of Patent: Jun. 19, 1990

[54] APPARATUS FOR PACKAGING IN A PROTECTIVE ATMOSPHERE

[75] Inventors: Frank D. Risko, Livonia; Duane F. Roycraft, Walled Lake, both of Mich.

[73] Assignee: Elopak Systems A.G., Glattbrugg, Switzerland

[21] Appl. No.: 362,829

[22] Filed: Jun. 7, 1989

[51] Int. Cl.[5] ..... B65B 31/02

[52] U.S. Cl. ..... 53/511

[58] Field of Search ..... 53/87, 88, 403, 432, 53/433, 510, 511

[56] References Cited

U.S. PATENT DOCUMENTS

| | | | |
|---|---|---|---|
| 2,506,769 | 5/1950 | Bergstein | 53/432 |
| 2,672,420 | 3/1954 | Jeremiah | 53/432 X |
| 3,477,192 | 11/1969 | Brown et al. | 53/432 |
| 3,942,301 | 3/1976 | Domke | 53/510 X |
| 4,094,121 | 6/1978 | Ganholt | 53/432 |
| 4,140,159 | 2/1979 | Domke | 53/510 X |
| 4,456,118 | 6/1984 | Kauffman et al. | 53/565 X |
| 4,602,473 | 7/1986 | Hayashi et al. | 53/510 |
| 4,703,609 | 11/1987 | Yoshida et al. | 53/432 X |
| 4,827,696 | 5/1989 | Arends et al. | 53/432 |

*Primary Examiner*—Robert L. Spruill
*Assistant Examiner*—Beth Bianca
*Attorney, Agent, or Firm*—John P. Moran

[57] ABSTRACT

An apparatus and method adaptable to a double indexing forming, filling and sealing machine for packaging liquid products in cartons, associated with the filling and top forming and sealing units for displacing with nitrogen the oxygen normally present in the headspace of the filled cartons. The apparatus includes a housing having a covered chamber and open bottom, with a diffuser screen and pairs of baffle arrangements therein for directing the nitrogen downwardly and forwardly into the leading carton of an aligned pair of filled but open-topped cartons, and downwardly and rearwardly into the trailing carton of the pair prior to sealing the end closures thereof.

4 Claims, 3 Drawing Sheets

APPARATUS FOR PACKAGING IN A PROTECTIVE ATMOSPHERE

TECHNICAL FIELD

This invention relates generally to an apparatus and method for reducing oxygen in the headspace of a thermoplastic paperboard carton and, more specifically, to an apparatus and method of directional flowing of an inert fluid into the carton to dilute and displace the oxygen present.

BACKGROUND ART

In the food processing industry, oxygen is reduced in the headspace of a package by injecting nitrogen, carbon dioxide or argon into the package to displace the air and, therefore, oxygen from the headspace. The reason for this is that oxygen adversely affects many food flavors and in particular vitamin C in fruit drinks. This replacement minimizes oxidation of the food stuffs to thereby substantially retard spoilage and increase the shelf-life of the packaged product.

In addition to nitrogen and argon, other antioxidants are known to prevent the oxidation of food, such as 14% bulyated hydroxyanisole, 6% propyl gallate, and 3% citric acid in ethyl alcohol for the protection of nuts.

More specifically, Buschkens et al Pat. No. 4,409,252 discloses a sequence of packaging steps wherein, after filling a container with a food product and covering same with a lid, the next step involves lifting one side of the lid slightly so that a protective gas, such as nitrogen, carbon dioxide, or argon, can be blown therein via a gas nozzle.

Bergstrom Pat. No. 3,481,100 advocates enclosing a container and a cover having one unclamped side in an evacuable chamber, evacuating the chamber and the container, introducing an inert or protective gas into the container and chamber, and hermetically sealing the cover.

Pohl Patent No. 4,448,011 discloses an inert gas wheel assembly including a shaft having axially aligned, apertured and oppositely rotatable wheels mounted thereon for introducing an inert atmosphere into a filled container.

Nishiguchi et al Pat. No. 4,805,768 includes a vertically suspended elevationally movable, cylindrical gas filling nozzle adaptable to being lowered into each container to inject an inert gas therein.

DISCLOSURE OF THE INVENTION

A general object of the invention is to provide an improved apparatus and method for reducing oxygen in the headspace of an open-topped container by directing an inert fluid therein to dilute and displace the oxygen therein.

Another object of the invention is to provide an improved apparatus and method for flooding the headspace of a container with nitrogen to affect a reduction of oxygen therein and thereby reduce oxidation of the product in the container.

A further object of the invention is to provide an apparatus for minimizing the oxygen in the headspace of filled cartons, adaptable to being incorporated between the filling and top forming units of machines having cooperating turret and conveyor mechanisms for indexing aligned pairs of cartons therealong; wherein the apparatus includes a chamber for receiving nitrogen from an external source, and a diffuser screen and selectively oriented baffles and shields for directing the nitrogen into the headspace of leading and trailing pairs of cartons indexed therebeneath.

These and other objects and advantages of the invention will be apparent when reference is made to the following drawings and accompanying description.

BEST MODE FOR CARRYING OUT THE INVENTION

Figure 1:
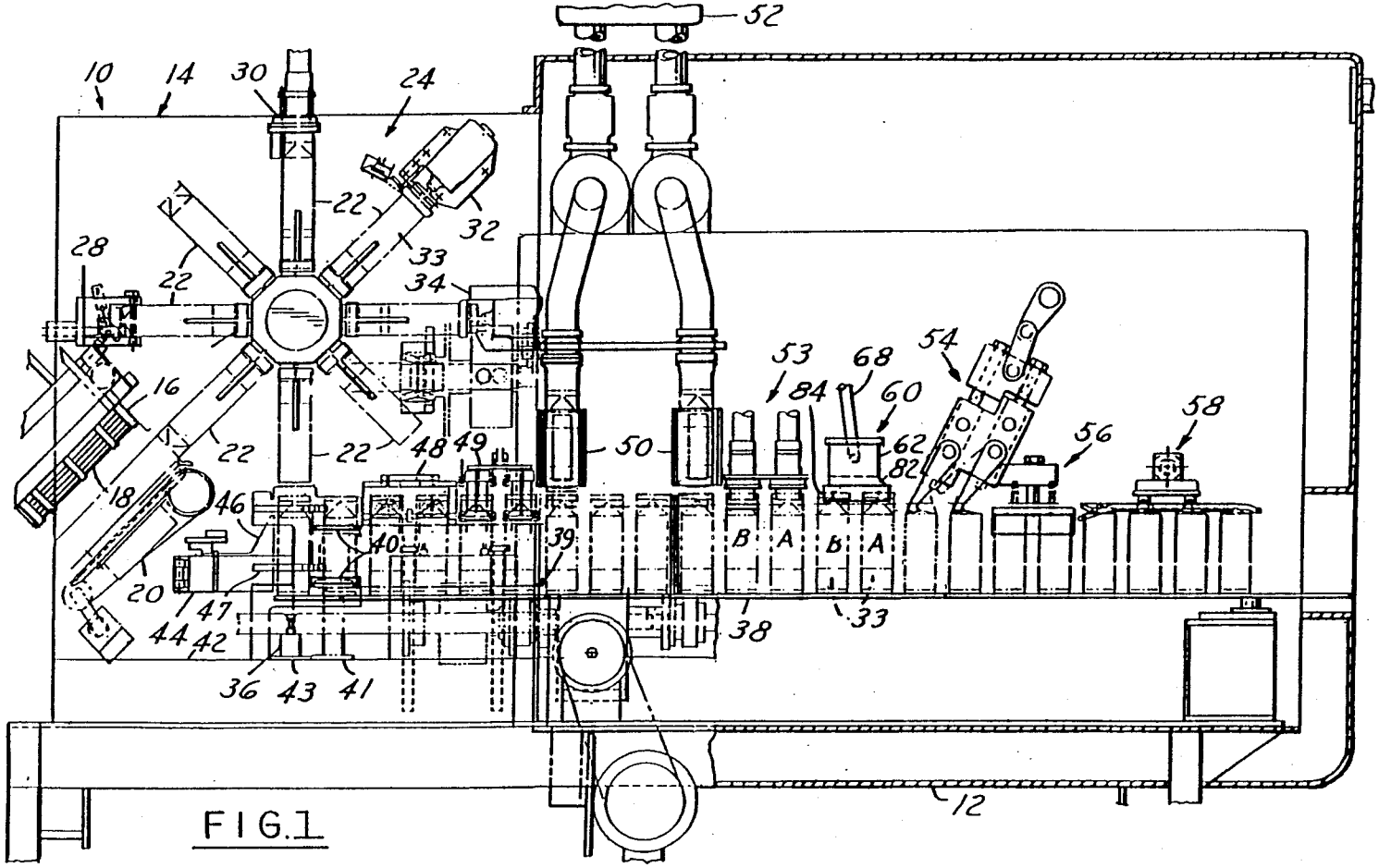
FIG. 1 is a side elevational view of a forming, filling and sealing machine embodying the invention.

Referring now to the drawings in greater detail, FIG. 1 illustrates a forming, filling and sealing machine 10 of the liquid packaging type, including a base frame 12, and a vertical support keel 14. The loading, forming, filling and sealing components are mounted on one side of the keel 14 as follows:

A magazine 16 for holding a plurality of paperboard blanks 18 is mounted on the one side of one end of the keel. A loading mechanism 20 is mounted on the keel just below the magazine 16 and adapted to withdraw one side-seamed flat blank at a time from the magazine while opening same into a four sided tube and then to load such individual tube onto one of eight mandrels 22 of an indexable turret mechanism 24. The latter is rotatably mounted on an upper portion of the keel 14. The receiving mandrel is positioned at 7:30 o'clock in FIG. 1 when a paperboard tube is slid thereon by the loading mechanism 20.

The mandrel indexes clockwise in FIG. 1 to a 9:00 o'clock position where two of the usual four bottom closure panels of the tube are pre-broken along preformed score lines by a pre-breaker unit 28. At the 12:00 o'clock position, the four bottom closure panels are heated by a suitable heater 30 operatively mounted on the keel 14 above the 12:00 o'clock mandrel. The bottom heated tube and mandrel 22 are next indexed to a 1:30 o'clock position where a closing and sealing unit 32 closes the bottom panels into an overlapped flat configuration, and under pressure, seals the overlapped panels together, changing the tube into a bottom sealed container or carton 33 suitable for containing a liquid. Thereafter the bottom sealed carton is indexed to a 3:00 o'clock position where it continues to cool, but which may include a second sealing unit 34 prior to being indexed to an unloading 6:00 o'clock position.

At the latter position, the carton is stripped from the mandrel 22 by a stripping unit 36 and pulled downwardly to rest on a stationary rail 38 extending laterally from between a pair of parallel endless conveyors 39 mounted around sprockets 40 during its dwell period. The rail 38 is supported on brackets 41 mounted on a support member 42 on one side of the keel 14. The stripping unit 36 is also mounted on the support member 42, supported thereon by a bracket 43. As the conveyors index rightward in FIG. the rotation of the turret mechanism 24 is coordinated with the movement of the conveyors so as to continuously supply bottom sealed cartons 33 at regular intervals, ready for transfer to the conveyors, in the following manner and operational sequence.

With the carton 33 thus seated on the rail 38, it is in position to be transferred. During the dwell period of the conveyors 39, a transfer mechanism 44 including suitable pusher 46 moves the first bottom-formed carton rightward in FIG. 1, along the rail 38 between guides 47, into position in a pocket formed by lugs (not shown) on the conveyors 39, after which the pusher 46 retracts. During the transfer period, the next mandrel 22 of the turret 24 indexes to the 6:00 o'clock position where the next carton is stripped from the mandrel by the stripping mechanism 36 and deposited on the rail 38, in position to be transferred. As the conveyors begin their indexing cycle, the first carton is advanced. While the indexing cycle of the conveyors 39 is in process, the pusher 46 moves the newest carton horizontally along the rail 38 into the entrance to the parallel conveyors 39 behind the now moving first carton, to be engaged by lugs (not shown) at the moving ends of the conveyors. In this instance, the pusher 46 is adapted to move a predetermined distance farther than it did for the preceding carton, in order to help assure that the carton keeps up with the moving conveyors until engaged thereby. Once again the pusher 46 retracts, ready for the next cycle of delivering two cartons from the turret 24 for each one index of the conveyors 39. The details of the single-to-dual-carton transfer means is shown and described in U.S. Pat. No. 4,456,118.

After a predetermined number of indexes of the conveyors 39, each succeeding pair of cartons is positioned beneath successive pairs of top pre-breaker units 48 and 49 where the two oppositely disposed top panels of each carton 33 are pre-broken along preformed respective conventional gable-shaped infold score lines. A pair of cartons is thereafter indexed into position beneath a pair of filling nozzles 50, each of which feeds a measured volume of a particular liquid, such as milk or juice, from a source 52 into the cartons. As the cartons 33 index in pairs A and B therefrom, their top panels are typically heated, and sealed into either a flat top or a gable top configuration by respective pairs of heating, sealing, tab heater and tacker units 53,54,56 and 58 mounted on the keel 14. Thereafter, at the end of the forward travel of the endless conveyors 39, the closed cartons are discharged onto any suitable track unit (not shown) to be readied for shipment.

It may be noted in FIG. 1 that a headspace purification mechanism 60 is mounted on the keel 14 intermediate the heating unit 53 and the sealing unit 54. The tab heater unit 56 and tab tacker unit 58 complete the carton sealing. As shown in greater detail in FIG. 2, the headspace purification mechanism 60 includes a rectangular housing 62 having a chamber 64 therein and a cover 66 thereon. A tube 68 communicates with the chamber 64 via an opening 70 formed in the panel 71 of the housinq 62, better seen in FIG. 3.

Figure 4:
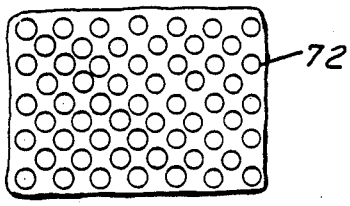
FIG. 4 is a fragmentary cross-sectional view taken along the plane of the line 4—4 of FIG. 2, and looking in the direction of the arrows.

A diffuser screen 72 (FIGS. 2 and 4) is mounted laterally across the chamber 64 a predetermined height above the bottom opening 74 of the chamber. A first pair of substantially parallel oriented baffles 76 and 78 are mounted respectively adjacent the left side wall of the housing 62 and at the center thereof below the diffuser screen 72. The two baffles are mounted at a predetermined angle so as to be directed downwardly and outwardly toward the left side.

A second pair of substantially parallel oriented baffles 80 and 82 are mounted respectively adjacent the right side wall of the housing 62 and at the center thereof, oppositely disposed with respect to the first pair of baffles 76 and 78.

Figure 2:
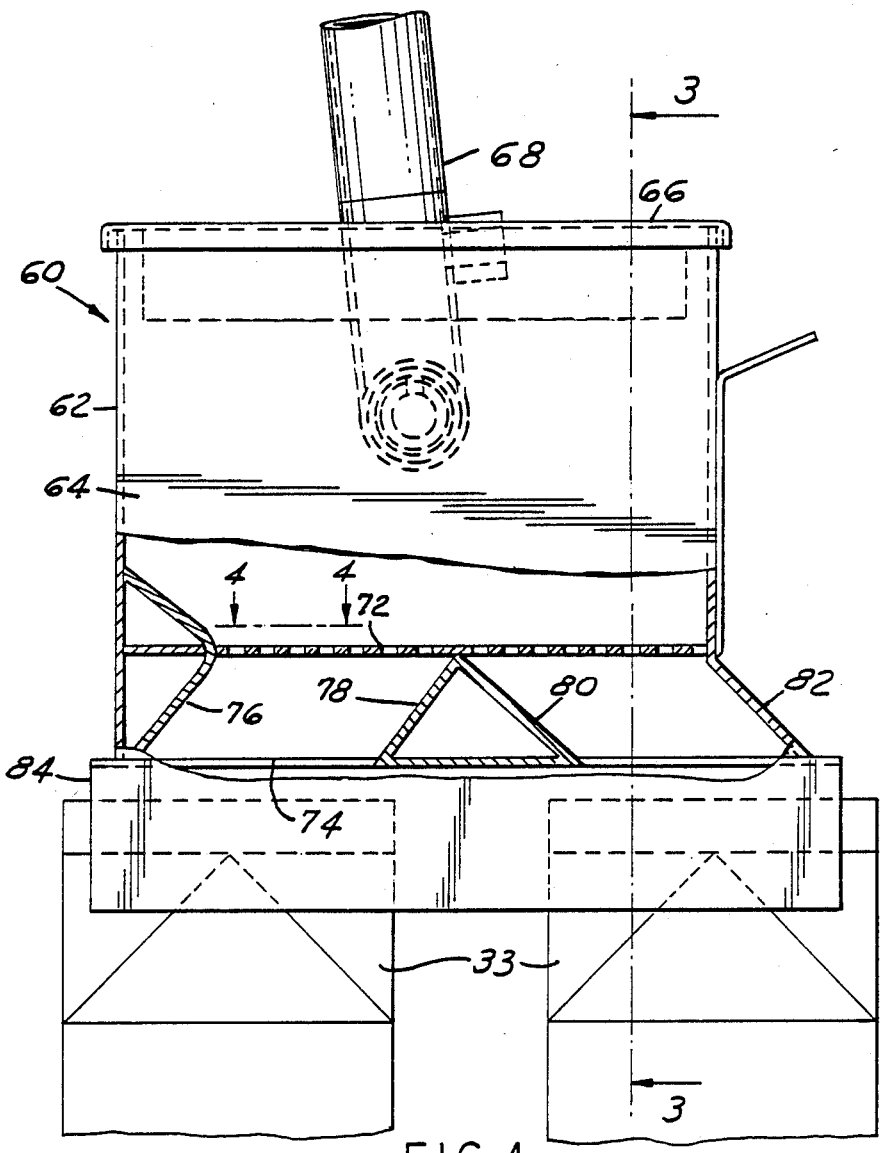
FIG. 2 illustrates a side elevational view of the directional flow apparatus portion of FIG. 1 embodying the invention.
Figure 3:
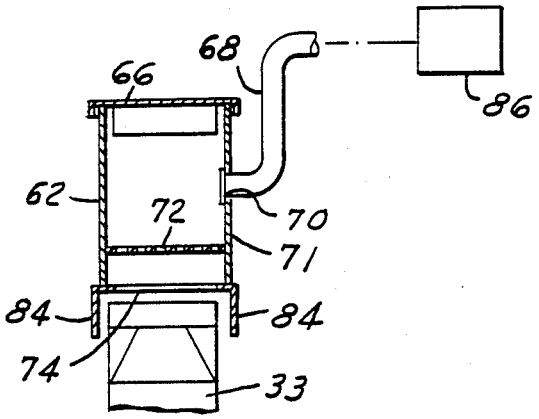
FIG. 3 is a cross-sectional view taken along the plane of the line 3—3 of FIG. 2, and looking in the direction of the arrows.

A pair of longitudinally oriented shields 84 are mounted just below the bottom opening 74, outward of the respective sides of the aligned cartons, spanning substantially the distance covered by two adjacent spaced apart cartons, as shown in FIG. 2.

In operation, nitrogen enters the chamber 64 from a source represented at 86 (FIG. 3) via the tube 68. The nitrogen is thereupon directly downwardly through the diffuser screen 72 and forwardly by the first pair of baffles 76 and 78 into the leading carton of a pair of double indexed cartons, and downwardly and rearwardly by the second pair of baffles 80 and 82 into the trailing carton of the pair of cartons. The shields 84 serve to prevent the nitrogen from flowing off to the sides of the open-topped cartons, and help to direct the nitrogen into the cartons atop the liquid content therein.

The pairs of cartons are then indexed onward to become sealed by the sealing unit 54, confining the nitrogen in the headspace of each closed and sealed carton. Completion of the operation is via the tab heater 56 and the tab tacker 58, as mentioned above.

Figure 5:
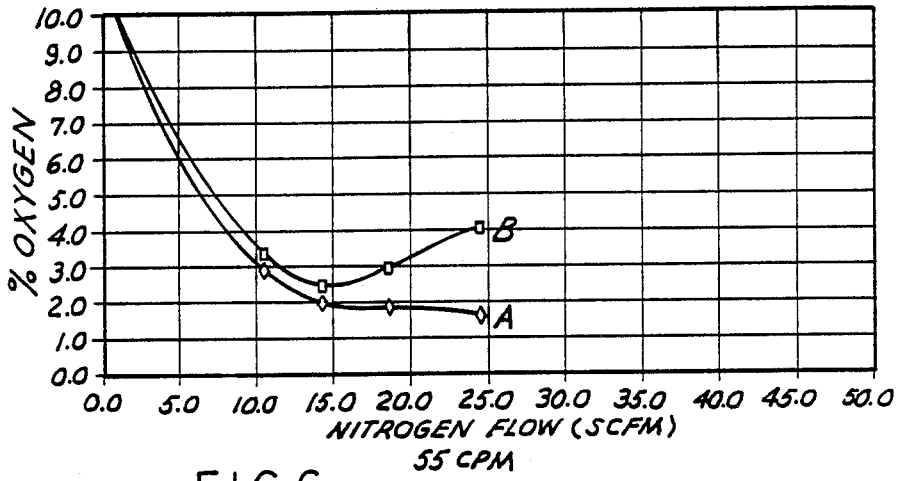
FIGS. 5 and 6 are graphic illustrations showing actual operational test results using the invention.
Figure 6:
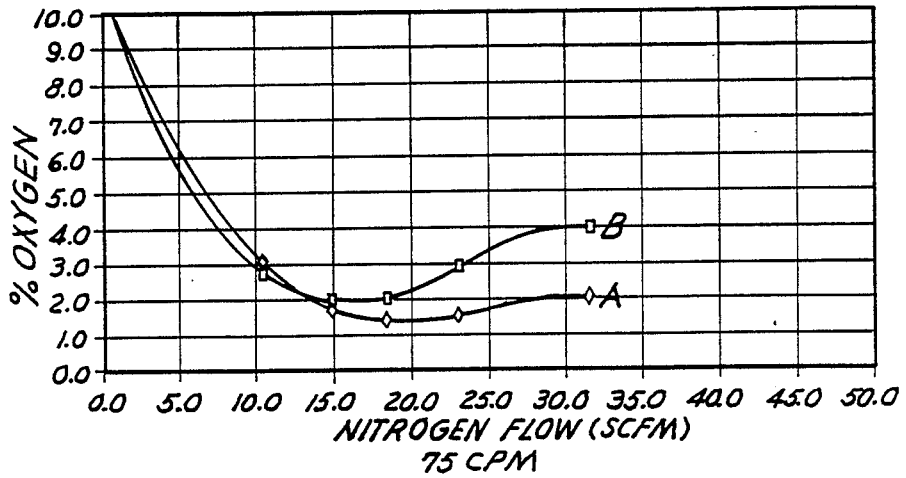

In actual tests, oxygen residuals in the cartons, after being flooded with nitrogen in the above described manner, were measured at from 1 to 3 per cent, with nitrogen flow measured at from 10 to 25 CFM, as substantially indicated in the test curves shown in FIGS. 5 and 6, at respective carton per minute rates of 55 and 75.

INDUSTRIAL APPLICABILITY

It should be apparent that the above described headspace purification mechanism provides an efficient and economical arrangement for displacing with nitrogen the oxygen normally present in the headspace of closed and sealed liquid-carrying containers, thereby minimizing oxidation of the liquid therein and substantially increasing the shelf life of the product.

It should also be apparent that the described arrangement could be readily modified to accommodate applications wherein only single cartons are indexed through the heating, forming, filling, and sealing operations.

It should be further apparent that the cartons whose headspaces are purified by the invention may be either of the gable top or flat end configuration, as well as either square or rectangular in cross section. While but one embodiment has been shown and described, other modifications are possible within the scope of the following claims.

The embodiments of the invention in which an exclusive property or privilege is claimed are defined as follows:

1. In a forming, filling, and sealing machine for cartons, said machine including an indexable turret mechanism having a plurality of radially oriented mandrels thereon for forming and sealing one of the end closures of said cartons, and a filling unit, end forming unit, and sealing unit located in seriatum downstream of said turret mechanism, and an indexable conveyor for double indexing said cartons as an aligned leading and trailing pair beneath said filling, forming and sealing units for operation thereon, a headspace purification mechanism mounted above said indexable conveyor for cooperation therewith and associated with said filling unit and said sealing unit for dispersing an inert gas downwardly into said cartons for displacing the oxygen normally present in the space above the contents provided by the filling unit which becomes a headspace in the successive closed and sealed carton, characterized by said headspace purification mechanism including a housing having a chamber therein, and a diffuser screen and suitable oriented baffles mounted in the chamber for directing said inert gas into said space above the contents of the carton just prior to closing and sealing thereof; said baffles including a first pair of substantially parallel oriented baffles mounted in said chamber adjacent one side thereof such that the passage between the baffles is angled in a downstream direction toward the leading carton, and a second pair of substantially parallel oriented baffles mounted in said chamber adjacent the opposite side thereof such that the passage between the baffles is angled in an upstream direction toward the trailing carton; and said diffuser screen being mounted laterally across said chamber just above said first and second pairs of baffles.

2. The headspace purification mechanism described in claim 1, wherein the inert gas is nitrogen.

3. The headspace purification mechanism described in claim 1, and a pair of shields operatively connected to the sides of said housing so as extend below said full bottom opening along the opposite sides of said first and second pairs of baffles to help direct the inert gas into each pair of cartons.

4. The headspace purification mechanism described in claim 1, and a source of inert gas, and a tube communicating from said source to said chamber through an opening formed in a side of said housing.

* * * * *